US005431195A

United States Patent [19]

Corain et al.

[11] Patent Number: 5,431,195

[45] Date of Patent: Jul. 11, 1995

[54] CONTROL SYSTEM FOR TUCK-IN SELVEDGE FORMING DEVICES IN A TERRY LOOM

[75] Inventors: Luciano Corain, Vicenza; Lucio Sardella, Schio; Costantino Vinciguerra, Florence, all of Italy

[73] Assignee: Nuovopignone-Industrie Meccaniche e Fonderia S.p.A., Florence, Italy

[21] Appl. No.: 246,074

[22] Filed: May 19, 1994

[30] Foreign Application Priority Data

May 28, 1993 [IT] Italy ..... MI93A1109

[51] Int. Cl.[6] ..... D03D 47/48; D03D 39/22

[52] U.S. Cl. ..... 139/434; 139/1 E

[58] Field of Search ..... 139/434, 1 E

[56] References Cited

U.S. PATENT DOCUMENTS 4,600,039 7/1986 Corain ..... 139/434
4,972,881 11/1990 Umezawa et al. ..... 139/434
5,246,038 9/1993 Corain ..... 139/434

FOREIGN PATENT DOCUMENTS 2538417 6/1984 France .
4206819 9/1992 Germany .
2213504 8/1989 United Kingdom .

*Primary Examiner*—Andrew M. Falik
*Attorney, Agent, or Firm*—Oblon, Spivak, McClelland, Maier, & Neustadt

[57] ABSTRACT

A control system for a plurality of tuck-in selvedge forming devices in a loom having a variable reed beat-up position includes a main shaft, a drive shaft connected to all the tuck-in selvedge forming devices, a modulator driven by the main shaft and having an output shaft which pauses at least once during each revolution of the main shaft, as well as a coupling unit rotatable with the drive shaft and operative to be selectively rotatably coupled to the modulator output shaft so that the drive shaft is driven by the main shaft. The coupling unit includes a ring fixed to the drive shaft and a first cover pivoted to the ring so that a key can enter into the recess of the modulator output shaft to rotatably couple the coupling unit to the modulator output shaft during its pauses. A second lever is biased so as to follow contours of a control cam and prevent the first key from entering the recess of the modulator output shaft. An electromagnet controlled by a logic unit cooperates with the second lever to prevent the second lever from engaging the first lever.

2 Claims, 3 Drawing Sheets

CONTROL SYSTEM FOR TUCK-IN SELVEDGE FORMING DEVICES IN A TERRY LOOM

BACKGROUND OF INVENTION

1. Field of Invention

This invention relates to a new control system for tuck-in selvedge forming devices in a loom, in particular a loom for terry cloth formed by varying the reed beat-up position which, by enabling a single command to automatically prevent the cut warp ends from being tucked into the shed for a predetermined number of reed beat-ups with the loom in operation, achieved by locking in their rest position the tuck-in members of all said tuck-in selvedge forming devices or selvedge formers of the loom, independently of the type of selvedge former used and hence also enabling positively controlled conjugate-cam selvedge formers to be used, enables the higher operating speeds currently required of modern terry looms to be achieved, together with considerable mechanical simplification of the loom.

2. Description of the Related Art

From the state of the art, various systems are already known for controlling the members of selvedge formers for terry looms of the type using different reed beat-up positions.

In said known selvedge formers, the members for tucking the cut weft ends into the shed at each reed beat-up or after a predetermined number of reed beat-ups generally consist, for each selvedge former, of a weft tuck-in hook and a movable member or foot for weft gripping and cutting, both undergoing rotation and translation or axial movement.

Said movements of the hook or foot are achieved independently of each other by separate operating cams which are keyed onto a single drive shaft rotated continuously by the main loom shaft and move corresponding spring-loaded operating levers pivoted at one end onto a single shaft.

The controlled prevention of tuck-in of the cut weft ends into the shed for a predetermined number of reed beat-ups is achieved by a system which locks both the rotation of the hook and the rotation and translation of the foot substantially by a movement selection mechanism present on each selvedge former, in which appendices or teeth protecting from said operating levers cooperate with corresponding stops mounted on a spring-loaded support shaft which by means of an electromagnet is movable axially parallel to said single pivoting shaft for said operating levers from a position retained by said loading spring, in which said stops engage said teeth, into a position in which they are not engaged so that the weft end is inserted at each reed beat-up. In this manner, to achieve continuous operation of all the movable members of the selvedge former and hence the continuous tuck-in of the cut weft ends into the shed to form the selvedge, it is necessary merely to energize said electromagnet which, by overcoming the action of said loading spring, moves the stops on the shaft out of interference with said teeth of the operating levers.

According to another known method, all movement by electromagnetic action is dispensed with in the movement selection mechanism, the electromagnet being used only to retain against itself, when energized, an element which has been brought into contact with it mechanically.

In other words, a bridge frame is made to rock, by the action of a feeler rigid with it and cooperating via a spring with one of said operational control cams, from a position in which its bridge interacts with said stops or teeth projecting from said operating levers to lock said levers in position, to a position in which there is no longer interaction and in correspondence with which a metal armature rigid with said feeler rests against an electromagnet which, if energized, retains it.

Again in this case said movable members of the selvedge former, ie the weft tuck-in hook and the weft gripping and cutting foot, remain locked and inactive until said electromagnet is energized, which by retaining against itself the armature and hence the frame, enables said operating levers to follow the pattern of their operating cams to hence move said movable members.

Said methods have however the drawback of requiring a multiplicity of mechanisms for selecting the movement of the movable members of the selvedge former, given that each selvedge former must have its own, and the practical difficulty of achieving the high operating speeds possible with positive conjugate-cam selvedge formers, in that the need to lock certain of said operating levers in position categorically prevents these latter being able to be positively moved by conjugate cams.

SUMMARY OF INVENTION

The object of the present invention is precisely to obviate said drawbacks by providing a control system only one of which is required for all the tuck-in selvedge forming devices used on the terry loom, and which does not require the movement of the specific internal members provided for tucking-in the cut weft ends to be selectively prevented, hence making it possible to use conjugate-cam selvedge formers.

This is substantially attained in that selecting the movement of those members which tuck the cut weft ends into the shed is now achieved for all the selvedge formers by one and the same drive shaft on which the operating cams of all the selvedge formers are keyed, which shaft no longer requires to be continuously rotated by the main loom shaft but needs to be moved only when said tuck-in is to take place.

In other words, the continuous movement of the main terry loom shaft is converted by a modulator of known type, such as that described in U.S. Pat. No. 4,924,915 into a movement of its output shaft which comprises at least one pause per loom revolution, during which pause a coupling unit can either couple or not couple said selvedge former drive shaft to said modulator output shaft under the control of a logic unit.

In this manner, the system operates whatever the type of selvedge former used, it acts simultaneously on all selvedge formers and in addition it tucks the cut weft ends into the shed each time the logic control unit is activated.

Hence, the control system for tuck-in selvedge forming devices in a loom for ferry cloth formed by varying the reed beat-up position, comprising a main shaft and a drive shaft for operating all said tuck-in selvedge forming devices, is characterised according to the present invention in that said drive shaft is rigid with a coupling unit which during the pauses of said output shaft can be coupled, under the control of a logic unit connected to it, to the output shaft of a modulator operated by said loom main shaft.

According to a preferred embodiment of the present invention, said coupling unit consists of a ring rigid with said drive shaft and carrying pivoted thereto a first lever loaded by a spring in the sense of inserting a key rigid with the lever into a corresponding recess provided in said modulator output shaft, this recess always being presented in front of said key during the pauses of said output shaft, said first lever cooperating with a second lever which, pivoted on the fixed casing of the system and loaded by a spring to follow the contour of a,control cam driven by said loom main shaft, tends to rotate said first lever in the sense of withdrawing said key from said recess and correspondingly inserting a second key of said first lever into a second fixed recess, a ferromagnetic plate rigid with said second lever cooperating with said logic unit, consisting of a fixed electromagnet, to exclude cooperation between said first and second lever.

In this manner, only when, during the pauses of the modulator output shaft, said fixed electromagnet is maintained energized and hence cooperation between the two said levers is interrupted, is the selvedge former drive shaft rotated by the modulator to effect said tuck-in.

BRIEF DESCRIPTION OF THE DRAWINGS

The invention is further described hereinafter with reference to the accompanying drawings which illustrate a preferred embodiment thereof by way of non-limiting example in that technical and constructional modifications can be made thereto without leaving the scope of the present invention.

In said drawings.

DETAILED DESCRIPTION OF THE PREFERRED EMBODIMENTS

Figure 1:
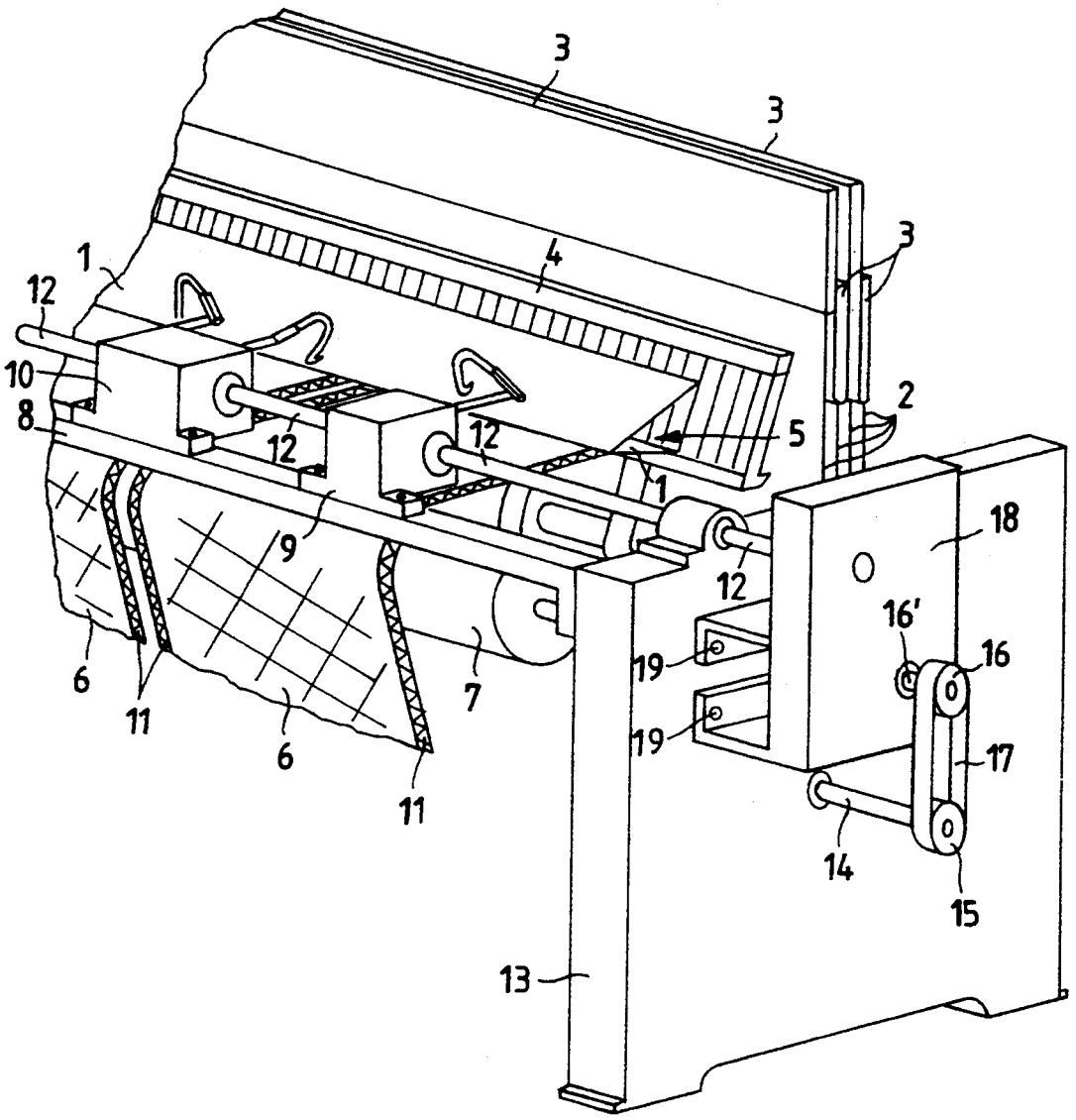
FIG. 1 is a partial perspective view of a terry loom using for the tuck-in selvedge forming devices the control system according to the invention.
Figure 2:
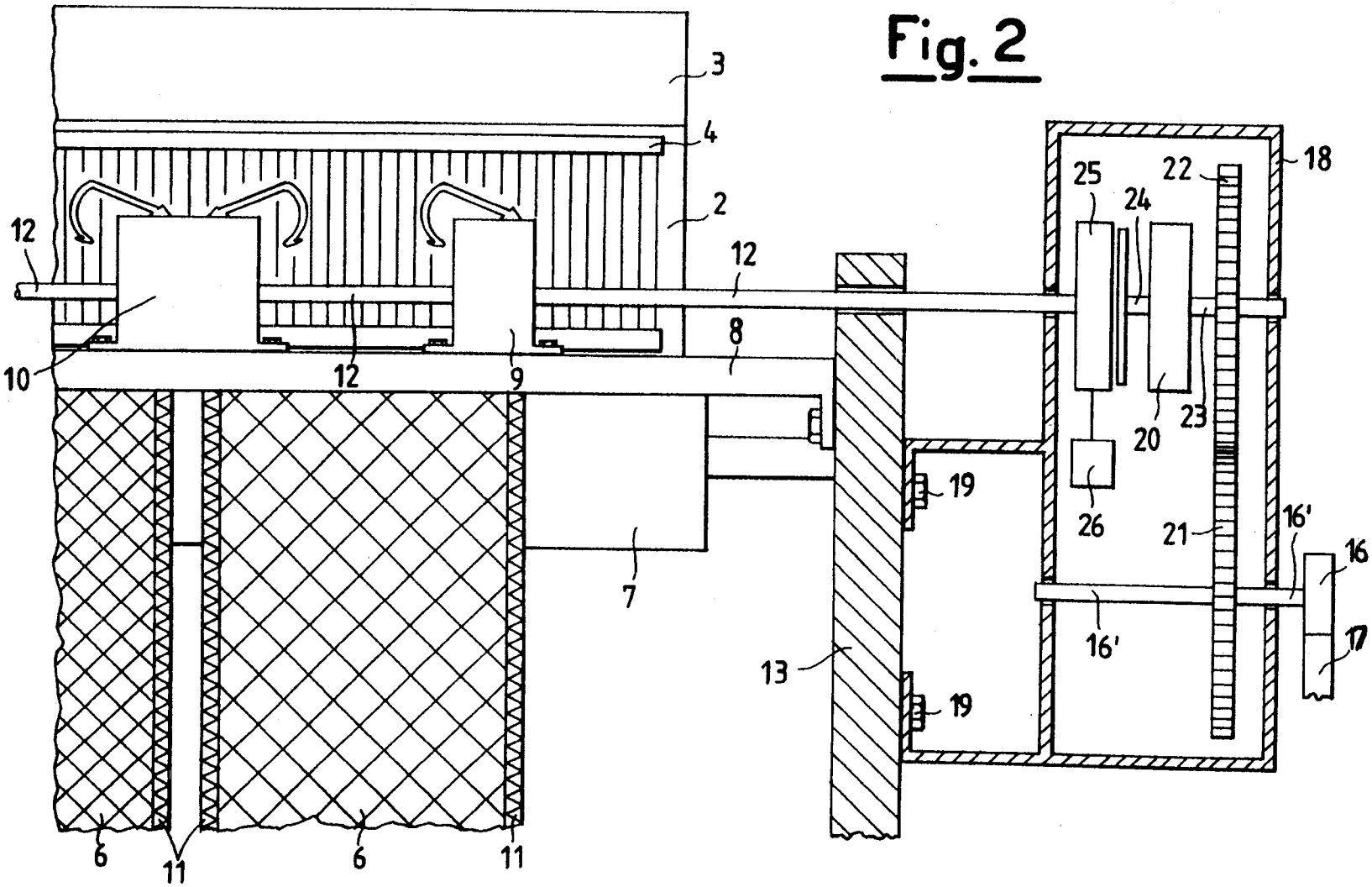
FIG. 2 is a schematic longitudinal section through the loom of FIG. 1 on an enlarged scale.

In the figures the reference numeral 1 indicates the warp yarns which originate from beams, not shown on the figure, and pass through the heddles 2 of the heddle frames 3 and the teeth of the reed 4 to form the shed 5 into which the weft yarns, not shown on the figure, are inserted go form the terry cloth 6 which is drawn by the take-up roller 7, to be wound on the beam, also not shown on the figure.

The devices 9 and 10 for forming tuck-in selvedges 11 are mounted on the loom front 8.

Said devices 9 and 10 are operated by a single drive shaft 12 which, supported by the loom shoulder 13, is rotated by the loom main shaft 14 via two pulleys 15 and 16 and a belt 17, and a control system contained in the box 18 fixed to said shoulder 13 by bolts 19.

Said system consists substantially of a modulator 20 driven by said main shaft 14 via two engaging gears 21 and 22, of which the gear 21 is rigid with said pulley 16 via the connection shaft 16', and the gear 22 is rigid with the input shaft 23 of said modulator 20. The modulator output shaft 24 having an enlarged end, which undergoes at least one pause at each revolution of the main shaft 14, can be coupled during said pauses to a coupling unit 25 rigid with said drive shaft 12. A logic unit 26 connected to said coupling unit 25 controls whether this coupling is effected or not.

Figure 3:
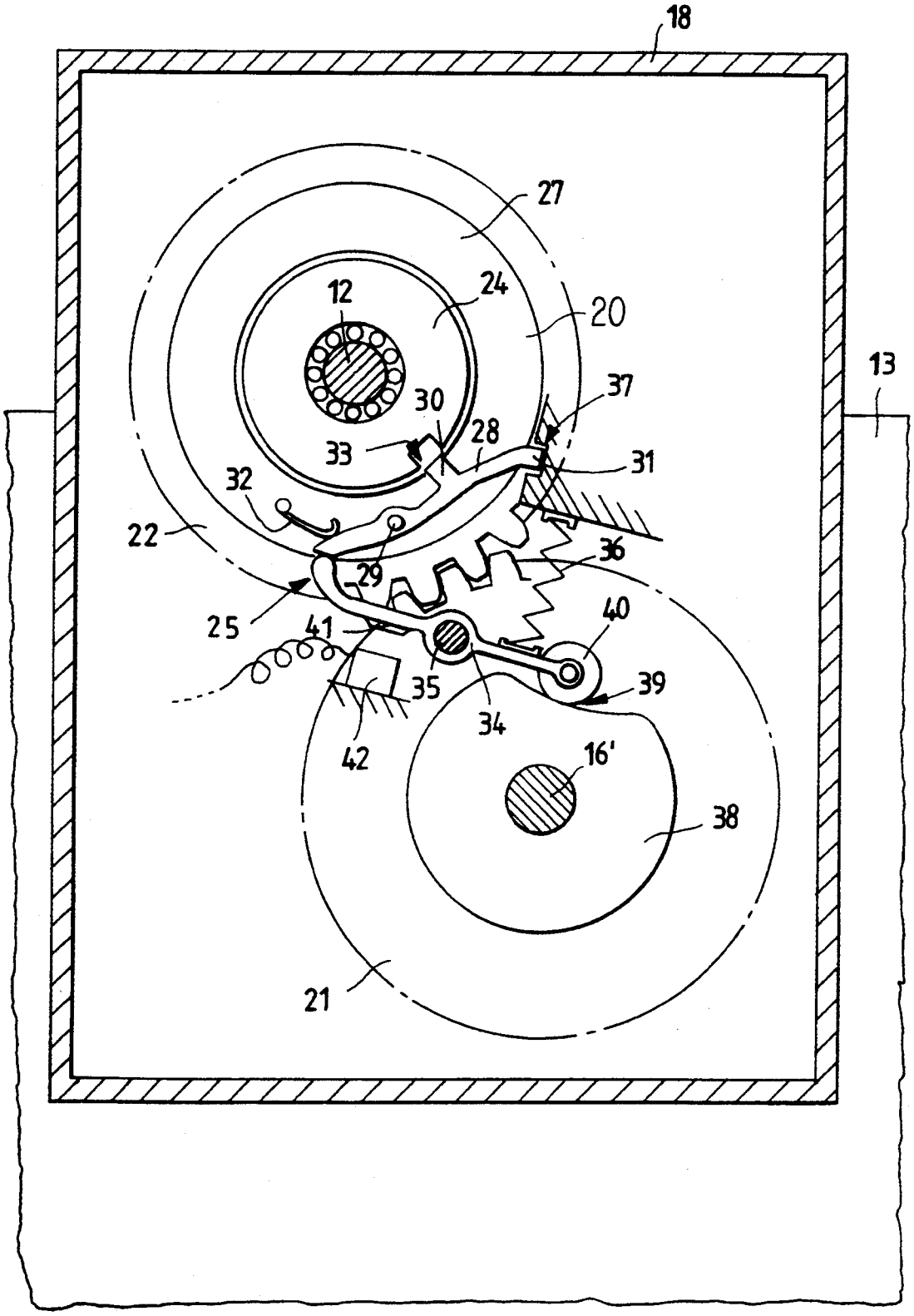
FIG. 3 is a front sectional view of a preferred embodiment of the invention on a highly enlarged scale.

In the embodiment of FIG. 3, said coupling unit 25 consists of a ring 27 which is rigid with said drive shaft 12 and carries a first lever 28 pivoted at 29 and comprising two keys 30 and respectively. Said lever is loaded by the spring 32 in the sense of inserting said key 30 into a corresponding recess 33 provided in said modulator output shaft 24, which 1s coaxial to said drive shaft 12 and always presents said recess 33 in front of said key 30 during said pauses. A second lever 34, pivoted on the pin 35 fixed to the box 18, is loaded by a spring 36 against said lever 28 to rotate it in the sense of withdrawing said key 30 from said recess 33 and correspondingly inserting said key 31 into a corresponding fixed recess 37 as clearly shown in FIG. 3.

Again, said lever 34 is compelled by said spring 36 to follow the contour of the control cam 38, which is keyed onto said connection shaft 16' and is hence driven by the main shaft 14.

At each pause of said modulator output shaft 24, said control cam 38 faces a depression 39 in front of the feeler 40 of said second lever 34 so that said lever, rotating clockwise, determines a clockwise rotation of the lever 28 and hence the withdrawal of the key 30 from the recess 33. However, rigid with said second lever 34 there is provided a ferromagnetic plate 41 which, when retained by an energized electromagnet 42 controlled by the logic unit 26, prevents said rotations of the two said levers 34 and 28, to hence allow the key 30 to remain inserted in said recess 33, this resulting in the movement of the ring 27 and consequently of the drive shaft 12 rigid with it, and hence the tucking of the weft ends into the shed 5 to form the selvedges 11.

Hence the selvedge formers 9 and 10 are operated only when said electromagnet 42 is energized.

We claim:

1. A control system in combination with a plurality of tuck-in selvedge forming devices in a loom having a variable reed beat-up position, comprising:

a main shaft in the loom;

a drive shaft connected to all of said tuck-in selvedge forming devices for driving said tuck-in selvedge forming devices;

a modulator driven by said main shaft and having an output shaft which pauses at least once during each revolution of said main shaft; and a coupling unit rotatable with said drive shaft and operative to be selectively rotatably coupled to said modulator output shaft so that drive shaft is driven by said main shaft, wherein said coupling unit includes a logic unit which controls selective rotatable coupling by the coupling unit.

2. The control system of claim 1 wherein said modulator output shaft has a recess, said main shaft has a control cam and said coupling unit further comprises:

a ring fixed to said drive shaft;

a first lever pivoted to said ring and biased so as to introduce a first key on said first lever into said recess of said modulator output shaft, so as to rotatably couple said coupling unit to said modulator output shaft, during the pauses of said modulator output shaft;

a second lever pivotable about a fixed axis and biased so as to follow contours of said control cam, said second lever engaging said first lever to prevent said first key from entering said recess of said modulator output shaft, and to introduce a second key of said first lever into a fixed recess in response to control by said control cam; and an electromagnet controlled by said logic unit and cooperating with said second lever to prevent said second lever from engaging said first lever.

* * * * *